United States Patent [19]

Wischusen, III

[11] Patent Number: 4,723,700

[45] Date of Patent: Feb. 9, 1988

[54] VENTED FOOD PACKAGE WITH MOISTURE PERMEABLE LINER

[75] Inventor: Henry Wischusen, III, Lilburn, Ga.

[73] Assignee: Rock-Tenn Company, Atlanta, Ga.

[21] Appl. No.: 912,263

[22] Filed: Sep. 26, 1986

[51] Int. Cl.[4] ..... B65D 75/38

[52] U.S. Cl. ..... 229/87 F; 229/120; 229/126; 229/902; 229/DIG. 14; 220/470

[58] Field of Search ..... 229/120, 127, 133, 44 R, 229/126, 902, 906, 903, DIG. 14, DIG. 13, 87 F; 220/400, 403, 408, 470

[56] References Cited

U.S. PATENT DOCUMENTS

| | | | |
|---|---|---|---|
| 948,524 | 2/1910 | Reid | 294/144 |
| 1,704,175 | 3/1929 | Coale | 229/903 |
| 2,011,179 | 8/1935 | Krout | 383/121 |
| 2,355,027 | 8/1944 | Manning | 229/16 A |
| 2,391,767 | 12/1945 | Beerend | 229/903 |
| 2,556,321 | 6/1951 | Denton | 229/87 F |
| 2,632,723 | 3/1953 | Bennett | 229/87 F |
| 2,900,122 | 8/1959 | Steiner | 229/87 F |
| 3,576,019 | 4/1971 | Sweeney et al. | 260/404.5 |
| 3,627,541 | 12/1971 | Farquhar | 99/171 R |
| 3,786,982 | 1/1974 | Rakes et al. | 220/315 |
| 3,883,068 | 5/1975 | Silver | 229/133 |
| 3,964,669 | 6/1976 | Sontag et al. | 229/87 F |
| 3,971,155 | 11/1975 | Bemiss | 229/903 |
| 4,228,945 | 10/1980 | Wysocki | 229/120 |
| 4,237,171 | 12/1980 | Laage et al. | 229/120 |
| 4,260,060 | 4/1981 | Faller | 229/906 |
| 4,351,699 | 9/1982 | Osborn, III | 162/112 |
| 4,441,626 | 4/1984 | Hall | 229/120 |
| 4,497,431 | 2/1985 | Fay | 229/DIG. 14 |
| 4,570,845 | 2/1986 | Hall | 229/45 R |
| 4,571,340 | 2/1986 | Ferrante et al. | 229/903 |
| 4,575,000 | 3/1986 | Gordon et al. | 229/87 F |

FOREIGN PATENT DOCUMENTS

| | | |
|---|---|---|
| 550665 | 1/1943 | United Kingdom . |

*Primary Examiner*—Willis Little

*Attorney, Agent, or Firm*—Jones, Askew & Lunsford

[57] ABSTRACT

A composite package for warm food items, and the like, in which a moisutre permeable flexible liner is laminated to a relatively rigid vented container base. Vent openings are provided by openings in the panels of the base, or by the open top of the base, all of which are enclosed by the liner. The liner is preferably treated to be impermeable to grease. Permeability of the liner to moisture allows moisture to escape from the interior of the package, while the liner prevents air circulation within the package and thereby keeps the contents from rapidly cooling.

23 Claims, 5 Drawing Figures

VENTED FOOD PACKAGE WITH MOISTURE PERMEABLE LINER

TECHNICAL FIELD

The present invention relates to packaging materials made of paper, paperboard, foam, and the like, and more particularly relates to a composite package in which a moisture permeable flexible liner is laminated to a relatively rigid vented base.

BACKGROUND ART

In the fast food industry, developing an ideal package for sandwiches, french fries, and the like, poses special problems. It is desirable to protect the product, but the package must be inexpensive. The package should occupy as little room as possible when shipped and stored awaiting use. It should be easy to use without much training or skill, and not awkward to close about the product. The package should retain heat, but allow some venting of moisture to prevent sogginess of buns or french fries. Most fast food products that are served warm generate water vapor. If this water vapor is confined by a package in the immediate vicinity of bread products or french fries, it will be absorbed and provide a limp sandwich or french fries which will be much less appetizing to the consumer opening the package.

Conventional package designs for the fast food industry usually provide only one or two of the desirable features listed above. Simple wax paper wrapping sheets for sandwiches, for instance, provide an assembly surface and retain heat to some extent, but also retain moisture. They provide almost no protection against crushing the product.

Open top french fry containers or bags provide considerable ventilation of moisture, but do not retain heat to keep the food warm between cooking and consumption. The air circulation that carries away the moisture also quickly transfers heat away from the food.

Some attempts have been made to combine flexible wrapping materials, which have cost and space-saving characteristics, with paperboard sleeves to help protect sandwiches. These attempts have been less than successful. U.S. Pat. No. 3,964,669 discloses a central rigid member which is folded to surround the sandwich with a rigid sleeve and provide a paperboard handle. An outer flexible sheet attached to the rigid member extends beyond the open ends of the sleeve and must be tucked in or twisted to close the package in an unstable, unreliable fashion. Furthermore, awkward panels formed in the paperboard must be lifted and held back in order to place the sandwich in its proper position. U.S. Pat. No. 4,575,000 discloses an inner layer of glassine type paper and an outer layer of paperboard, again forming a rigid sleeve around the sandwich being wrapped. The extending glassine paper ends of the sleeve must be tucked under the sandwich, so that no positively fastened closure is provided. In using the packages disclosed in these patents, the tucking required to complete the package may result in crushing the contents. Neither the package configuration nor the nature of the flexible material allows moisture to be vented. Furthermore, the principle is followed that the paperboard portion must surround the sandwich and form the top closure over the sandwich.

Other prior patents showing paperboard containers having coated or lined interiors are U.S. Pat. Nos. 1,704,175; 2,011,179; 2,556,321; and 3,627,541.

Thus, a need has existed in the art for a package for warm food items that protects the item, encloses the item and prevents air circulation in order to retain heat, but permits the escape of moisture to prevent the item from becoming soggy.

SUMMARY OF THE INVENTION

The present invention solves problems in the packaging art by providing a flexible moisture permeable liner laminated to a vented base container formed of a more rigid material.

Generally described, the present invention provides a package, comprising a container base of relatively rigid material; a liner laminated to the interior of the container base, the liner being permeable to moisture; the container base defining at least one vent opening exposing the liner to the exterior of the package; and means for retaining the liner in a position essentially completely enclosing an item placed in the lined container base. In a preferred embodiment, the container base includes a bottom panel and a plurality of side panels extending generally upwardly from the bottom panel, such that the container base has an open top, and the vent opening is the open top of the container base. In this configuration, the liner can be brought together above the base to enclose the package and provide a handle. Additional vent openings can be formed in the side panels.

Alternately, the container base can enclose the item, the means for retaining the liner in a position enclosing the item can be a means for holding the base in a closed configuration, and the vent opening can be an opening defined in the material of the container base.

The relatively rigid material preferably is paperboard, but the base can also be formed of other relatively rigid materials, such as synthetic resinous foam, an example of which is Styrofoam. The liner preferably is tissue paper treated with a fluorocarbon material so as to be impermeable to grease and permeable to moisture.

When the material of the liner is brought together to form a handle, several means for joining the liner material can be utilized, such as cohesive applied to facing surfaces, mechanical crimping, peel-away tape or staples.

The present invention also provides a composite blank for forming a package, comprising a cross-shaped base comprising paperboard or the like, including a bottom panel and a plurality of side panels extending outwardly from the bottom panel, with the side panels defining vent openings therein; and a flexible, moisture permeable liner sheet laminated to the base, and extending outwardly beyond each of the side panels.

The present invention also provides a method of packaging a warm, moisture-producing item, comprising the steps of laminating a moisture permeable flexible liner to the interior of a relatively rigid container base, the container base defining at least one vent opening exposing the liner to the exterior of the container base; placing the item into the lined container base; and positioning the liner to essentially completely enclose the item such that steam from the liner may pass through the liner and vent opening to the environment.

Thus, it is an object of the present invention to provide an improved package for items that emit moisture.

It is a further object of the present invention to provide a warm food package that retains heat while venting moisture.

It is a further object of the present invention to provide such a package that is inexpensive to fabricate and easy to use.

It is a further object of the present invention to provide a food package which retards air circulation within the package without trapping moisture.

Other objects, features, and advantages of the present invention will become apparent upon reading the following detailed description of embodiments of the invention, when taken in conjunction with the accompanying drawing and the appended claims.

DETAILED DESCRIPTION

Figure 1:
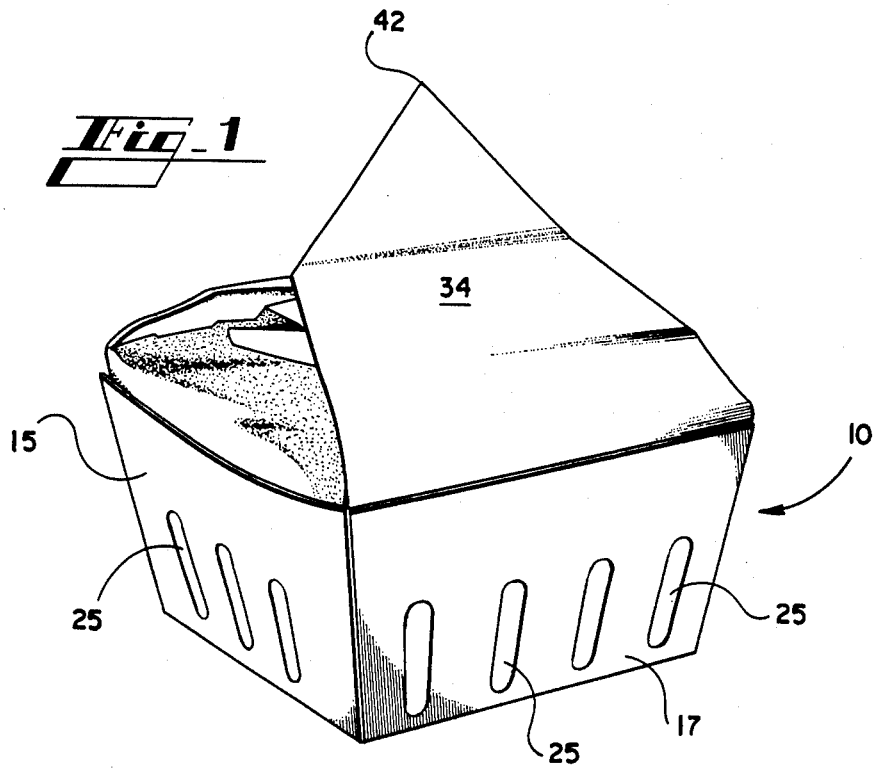
FIG. 1 is a pictorial view of a package embodying the invention.
Figure 2:
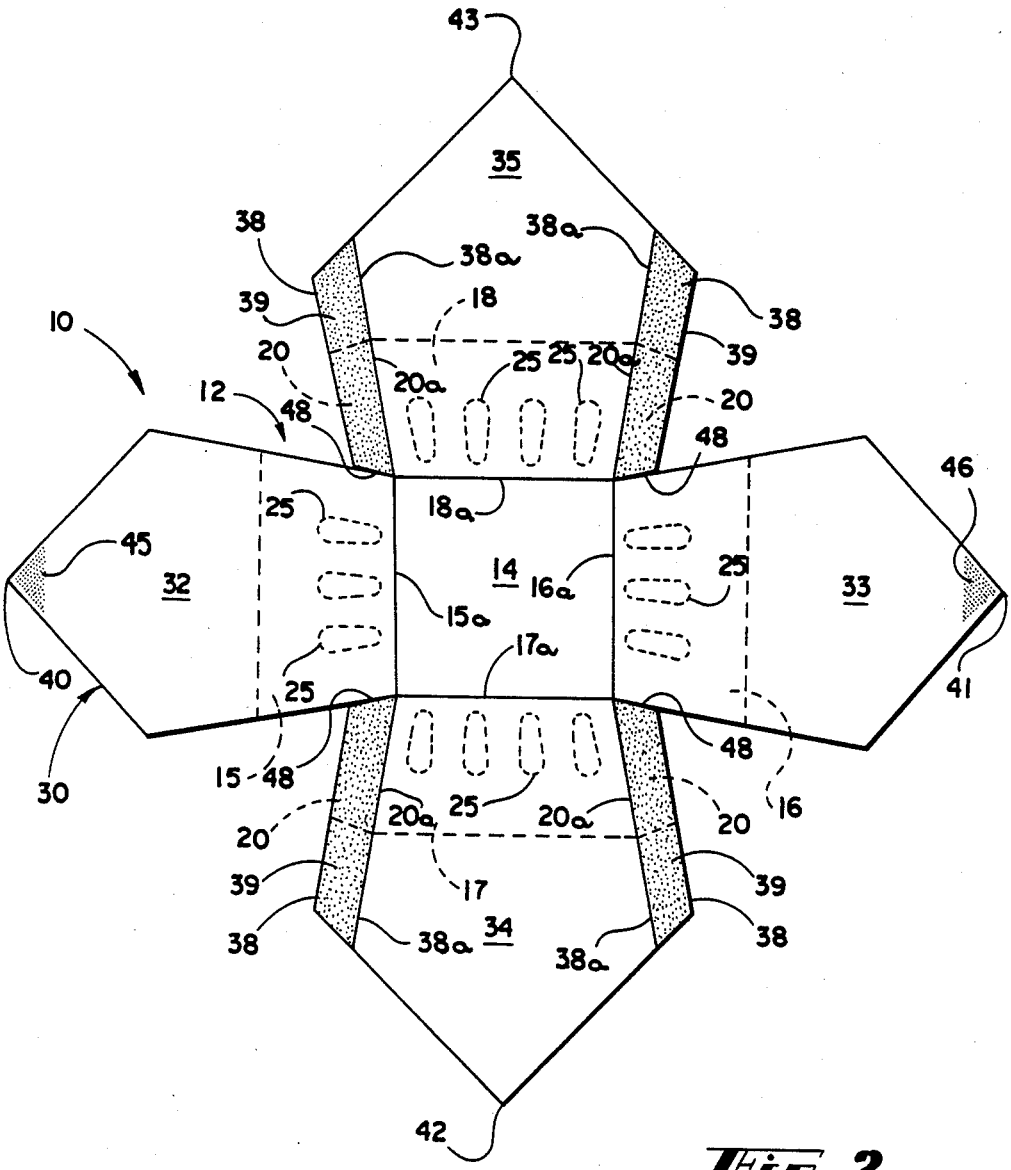
FIG. 2 is a plan view of a composite blank from which the package of FIG. 1 can be erected.

Referring now in more detail to the drawing, in which like numerals refer to like parts throughout the several views, FIG. 1 shows a preferred form of a package 10 embodying the invention. FIG. 2 shows a composite blank from which the package 10 can be assembled. The inner surface of the blank is shown in FIG. 2.

The package 10 includes a container base 12 constructed of paperboard or a similar, relatively rigid material that can be scored and folded. The base 12 is shown in dotted lines in FIG. 1 under a flexible liner sheet 30 which is laminated to the base 12 by means of an adhesive. Alternatively, the base 12 and liner 30 can be heated sealed together if made from or coated with appropriate materials. The base consists of a central bottom panel 14 and four side panels 15, 16, 17 and 18 connected to edges of the bottom panel 14 along scores or fold lines 15*a*, 16*a*, 17*a* and 18*a*, respectively.

The bottom paneo is preferably square when the package is to be used for fast food sandwiches or "nuggets," and the side panels preferably extend along an entire side of the square bottom panel and taper outwardly as they extend away from the bottom panel, each forming a quadrilateral shape, as shown. As will be better understood from the description below, this shape makes the opening of the paperboard base larger than the bottom panel, which facilitates nesting of the packages for storage. It will be understood, however, that the base can be formed having any desired shape. In containers which have a bottom panel, it can be formed in other rectangular or non-rectangular shapes with appropriately shaped side panels, without departing from the present invention. For example, the bottom panel could be round, with a cylindrical or frusto-conical side wall attached thereto.

Four glue flaps 20 are foldably connected to both side edges of the opposing pair of side panels 17 and 18 along score lines 20*a*. The glue flaps permit the package 10 to be assembled into the form shown in FIG. 3.

Each of the side panels 15–18 defines a plurality of vent openings 25. These vent openings 25 extend through the paperboard of the base 12 but are closed by the material of the liner 30 which is laminated against the inner surface of the base 12 after the vent openings 25 are cut out. Although shown only in the side panels in the preferred embodiment, vent openings can be formed in any surface of a container lined according to the present invention.

The flexible liner sheet 30 is cross-shaped and generally corresponds to the shape of the base 12. However, as shown in FIG. 2, the liner extends outwardly beyond each of the side panels 15, 16, 17 and 18 to form a plurality of cover portions 32, 33, 34, and 35, respectively. The cover portions 34 and 35 further define a total of four glue flaps 38 extending outwardly beyond each of the paperboard glue flaps 20. The glue flaps 38 are connected to the cover portions 34 and 35 along creases 38*a* which are colinear with the score lines 20*a*.

The liner 30 can be limp or have a degree of rigidity, so long as it is sufficiently flexible to be folded together above the bottom panel as described below. The preferred liner material is tissue paper treated in a known manner with fluorocarbons to render it impervious to grease while remaining permeable to moisture. Untreated tissue paper can be utilized. The fiber length of the tissue paper is preferably selected to provide a degree of rigidity and strength so that the liner material will stand up as shown in FIG. 3, and will not tear when formed into a handle, as shown in FIG. 4 and described below.

The periphery of each cover portion 32, 33, 34, 35 is formed as a pointed end 40, 41, 42, and 43, respectively. The cover portions 32 and 33 have areas of cohesive 45 and 46 applied adjacent to the pointed ends 40 and 41 on the inner surface of the liner 30, as shown in FIG. 2.

In the blank shown in FIG. 2, both the container base 12 and liner 30 are slit along four cut lines 48 to separate the glue flaps 20 and 38 from the adjacent side panels 15 and 16. Lines of adhesive 49 are applied along the side edges of the liner material covering side panels 15 and 16 and the associated cover portions 32 and 33. Alternately, the adhesive could be applied to the exterior surfaces of the glue flaps 20 and 38.

Figure 3:
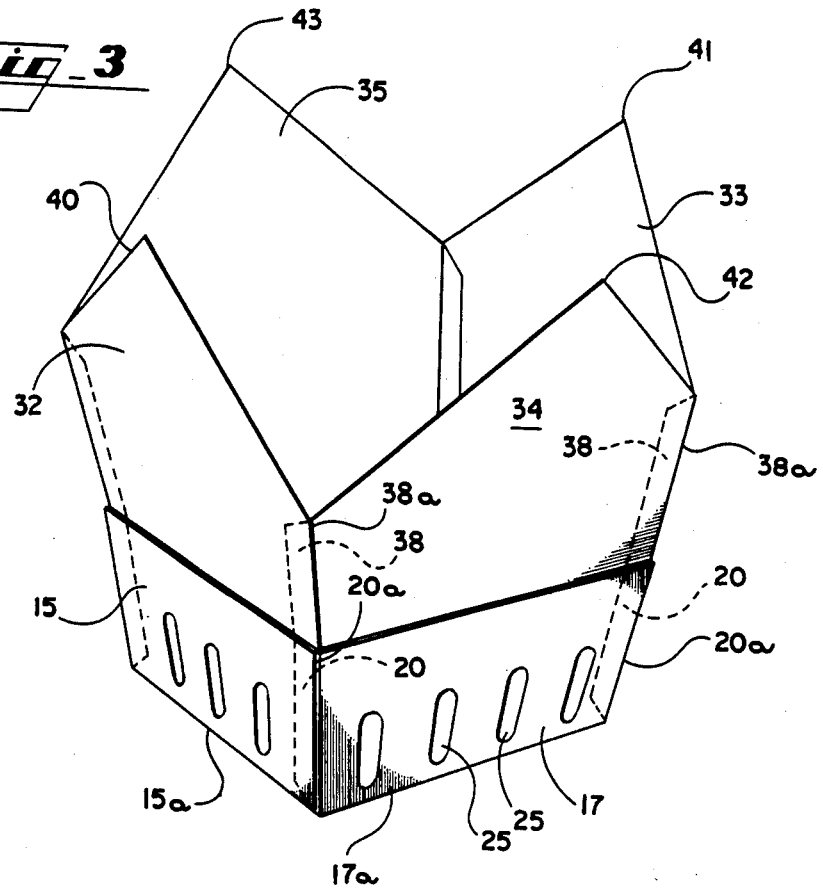
FIG. 3 is a pictorial view of the package of FIG. 1 in an erected, but not closed, configuration.
Figure 4:
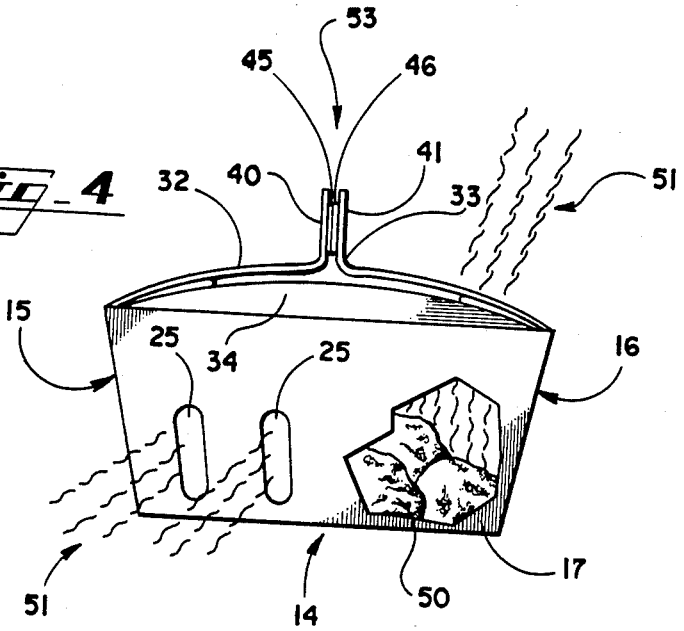
FIG. 4 is a side plan view of the package of FIG. 1.

It will thus be seen that in order to assemble the composite blank shown in FIG. 2 into the erected form shown in FIG. 3, each set of glue flaps 20 and 38 are folded inwardly as a unit. The side panels 15–18 and attached liner material are folded upwardly about scores 15*a*–18*a* until the glue flaps 20 and 38 meet the side panels 15 and 16. The adhesive 49 connects the glue flaps 20 and 38 to the interior surfaces of the side panels 15 and 16.

As shown in FIG. 3, the erected container base 12 thus formed has the shape of an inverted truncated pyramid. The container base 12 is fully lined by the liner 30, and the cover portions 32–35 of the liner extend upwardly at the same angle as the side panels 15–18. It will be understood by those skilled in the art that the shape of the package 10 shown in FIG. 3 allows multiple packages 10 to be nested together for transportation and storage.

When it is desired to use the package 10, a food item 50, such as chicken nuggets shown in FIG. 4, is placed into the container base 12. Thereafter the opposite cover portions 34 and 35 are folded inwardly over the food item 50, and the other pair of cover portions 32 and 33 are brought together to join the areas of cohesive 45 and 46, as shown in FIG. 4. The entire open top of the container base 12 is now covered with material of the liner 30, which functions as a large vent opening. In the type of package shown in FIGS. 1–4, the vent openings 25 in the side panels can be optionally eliminated, although a package embodying the invention operates more efficiently with side panel vent openings.

Water vapor 51, shown diagrammatically in FIG. 4, comes off the enclosed food item 50 into the package 10. Furthermore, cooking grease (not shown) may drip from the food item 50 onto the side panels and bottom panel of the package. The liner 30 prevents the grease from saturating the paperboard of the container base 12 or leaking out the vent openings 25. However, the vapor 51 passes through the material of the liner 30 at the vent openings 25 and positioned over the top of the container base. The venting of this moisture occurs without significant air circulation from the exterior of the package, so that the food item stays warm but is not made soggy by exposure to excessive water vapor.

The closed package 10 shown in FIGS. 1 and 4 may be lifted by a handle 53 formed by the joinder of the cover portions 32 and 33 at their pointed ends 40 and 41. When the contents are to be eaten, the pointed ends 40 and 41 are individually grasped and pulled apart to separate the cohesive. The cover portions 32–35 may then easily be lifted away from the food item 50, which can then be removed as desired. The package can be reclosed, if desired, simply by refolding the cover portions over the food and pressing the cohesive together again.

Alternate ways of joining the cover portions to form the handle 53 include mechanical crimping, peel-away tape, staples, or other suitable means.

Figure 5:
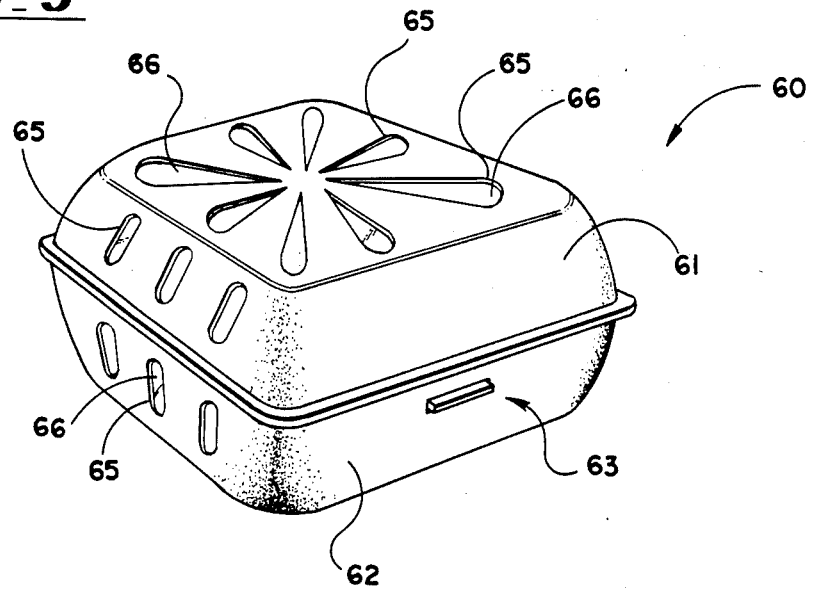
FIG. 5 is a pictorial view of a second embodiment of the invention in a foam container.

Another embodiment of the present invention is represented by the package 60 shown in FIG. 5. The package 60 includes a fully enclosed container base formed from molded synthetic resinous foam, such as Styrofoam. A top section 61 is connected in a conventional manner by an integral hinge (not shown) to a bottom section 62. A conventional locking mechanism 63 is integrally formed to selectively hold the top 61 and bottom 62 together.

Vent openings 65 are formed in the top 61 in both the horizontal and generally vertical surfaces thereof. Vent openings 65 are formed also in the generally vertical surfaces of the bottom section 62. A liner 66, of the same material discussed above in connection with the liner 30, is laminated to the interior surfaces of the top 61 and bottom 62, and can be seen through the vent openings 65 in FIG. 5. As in the first embodiment described above, the liner 66 essentially completely enclosed the contents of the package 60.

The package 60 is loaded and used in the conventional manner for such packages. The vent openings and liner operate in the same manner as the vent openings 25 and liner 30 of the first embodiment to trap grease while venting moisture from the interior of the package 60. It will be understood that container bases fully enclosing the contents and embodying the present invention can be made from other materials, such as paperboard.

Thus, it will be seen that the present invention provides a package for warm food items that protects the item, encloses the item and prevents air circulation in order to retain heat, but permits the escape of moisture to prevent the item from becoming soggy. The package is also useful for enclosing many other types of items.

While this invention has been described in detail with particular reference to preferred embodiments thereof, it will be understood that variations and modifications can be effected within the spirit and scope of the invention as described hereinbefore and as defined in the appended claims.

I claim:

1. A package, comprising:

a container base of relatively rigid material;

a liner laminated to the interior of said container base, said liner being permeable to allow moisture to pass therethrough;

said container base defining at least one vent opening exposing the exterior surface of said liner to the exterior of said package; and means for retaining said liner in a position essentially completely enclosing an item placed in said lined container base.

2. The package of claim 1, wherein said container base comprises a bottom panel and a plurality of side panels extending generally upwardly from said bottom panel; and wherein said container base has an open top enclosed by said liner; said vent opening comprising the open top of said container base.

3. The package of claim 2, further comprising additional vent openings formed in said side panels.

4. The package of claim 1, wherein said container base encloses said item, said means for retaining said liner in a position enclosing said item comprises means for holding said base in a closed configuration, and said vent opening comprises an opening defined in said base.

5. The package of claim 4, wherein said relatively rigid material comprises paperboard.

6. The package of claim 5, wherein said liner comprises tissue paper treated with a fluorocarbon material so as to be impermeable to grease and permeable to moisture.

7. The package of claim 4, wherein said relatively rigid material comprises synthetic resinous foam.

8. The package of claim 1, wherein said liner comprises tissue paper.

9. The package of claim 1, wherein said liner comprises tissue paper treated to be impermeable to grease while being permeable to moisture.

10. The package of claim 9, wherein said tissue paper is treated with a fluorocarbon material.

11. A package, comprising:

a base tray comprising paperboard or the like, including a bottom panel and one or more side panels extending upwardly from said bottom panel;

a flexible liner comprising a moisture permeable material, said liner being laminated to the interior of said base, so as to cover said bottom and said one or more side panels of said base, and defining one or more cover portions extending outwardly from each of said one or more side panels; and means for securing said one or more cover portions to close said package above said base.

12. The package of claim 11, wherein at least one of said side panels defines therein a vent opening exposing said liner to the exterior of said package.

13. The package of claim 11, wherein said bottom panel and side panels are rectangular, and wherein four of said side panels extend upwardly from four edges of said bottom panel and four of said cover portions extend outwardly from said side panels.

14. The package of claim 11, wherein said means for securing said cover portions forms said cover portions into a handle means above said package.

15. The package of claim 11, wherein said means for securing said cover portions comprises cohesive applied to facing surfaces of said cover portions.

16. The package of claim 11, wherein said means for securing said cover portions comprises crimped areas of said cover portions securing them together.

17. The package of claim 11, wherein said means for securing said cover portions comprises peelaway tape.

18. A composite blank for forming a package, comprising:

a cross-shaped base comprising paperboard or the like, including a bottom panel and a plurality of side panels extending outwardly from said bottom panel said side panels defining vent openings therein; and a flexible, moisture permeable liner sheet laminated to said base, and extending outwardly beyond each of said side panels.

19. A method of packaging a warm, vapor-producing item, comprising the steps of:

laminating a moisture permeable flexible liner to the interior of a relatively rigid base container, said base container defining at least one vent opening exposing the exterior surface of said liner to the exterior of said base container;

placing said item into said lined base container; and positioning said liner to essentially completely enclose said item such that vapor from said liner may pass through said liner and vent opening to the environment.

20. A package, comprising:

a container base of relatively rigid material comprising at least a bottom panel and a plurality of side panels extending generally upwardly from said bottom panel;

a liner laminated to the interior of said container base, said liner being permeable to moisture;

said container base defining at least one vent opening exposing said liner to the exterior of said package; and means for retaining said liner in a position essentially completely enclosing an item placed in said lined container base;

said container base having an open top enclosed by said liner; and said vent opening comprising the open top of said container base.

21. A package, comprising:

a container base of paperboard enclosing an item placed therein;

a liner laminated to the interior of said container base, said liner comprising tissue paper treated with a fluorocarbon material so as to be impermeable to grease and permeable to moisture;

said container base defining at least one vent opening in said base exposing said liner to the exterior of said package; and means for holding said base in a closed configuration so as to retain said liner in a position essentially completely enclosing said item placed in said lined container base.

22. A package, comprising:

a container base of relatively rigid material;

a liner laminated to the interior of said container base, said liner comprising tissue paper treated with a fluorocarbon material to be impermeable to grease while being permeable to moisture;

said container base defining at least one vent opening exposing said liner to the exterior of said package; and means for retaining said liner in a position essentially completely enclosing an item placed in said lined container base.

23. The package of claim 1, further comprising a plurality of vent openings defined in said base and closed by said liner.

* * * * *